United States Patent [19]

Kintanar

[11] 4,016,027

[45] Apr. 5, 1977

[54] COSMETIC GLOVES

[75] Inventor: Jane Kintanar, Flushing, N.Y.

[73] Assignee: Lawrence Peska Associates, Inc., New York, N.Y. ; a part interest

[22] Filed: Mar. 24, 1976

[21] Appl. No.: 670,178

[52] U.S. Cl. ..... 2/159; 128/77

[51] Int. Cl.[2] ..... A41D 19/00

[58] Field of Search ..... 128/77, 381, 260, 272, 128/165; 2/158, 159, 167, 162, 16, 168, 46, 59, 161 R

[56] References Cited

UNITED STATES PATENTS

| | | | |
|---|---|---|---|
| 1,117,077 | 11/1914 | Mooney | 2/16 |
| 1,751,872 | 3/1930 | Medaugh | 2/159 |
| 2,045,157 | 6/1936 | Mathias | 2/16 |
| 2,069,643 | 2/1937 | Burke | 2/162 X |
| 3,253,589 | 5/1966 | Shook | 2/16 X |
| 3,327,320 | 6/1967 | Forsyth | 2/158 |
| 3,341,861 | 9/1967 | Robbins | 2/167 X |
| 3,774,242 | 11/1973 | Owen | 2/158 |
| 3,883,898 | 5/1975 | Byrnes | 2/167 |

*Primary Examiner*—G. V. Larkin

[57] ABSTRACT

A pair of cosmetic gloves formed from sheer and elastomeric yarn, which when worn smooth and firm wrinkled skin which is exposed to view. The gloves have hand and arm-receiving portions which can be connected. Overlapping straps are also provided on the back of the arm-receiving portions which are adjustably connected to vary the tension applied by the gloves to the skin.

2 Claims, 3 Drawing Figures

COSMETIC GLOVES

BACKGROUND OF THE INVENTION

This invention relates to a garment, and more particularly, a pair of gloves designed to be worn for cosmetic purposes.

Gloves are usually designed to cover, rather than expose the hands and arms of the wearer for a variety of reasons, such as protection of the wearer from cold, moisture, dust, etc. or to hide unsightly skin on the hands and arms. However, no gloves have been designed heretofore to display the hands and arms to show smooth and firmed wrinkled skin on the wearer while still protecting the wearer from cold and moisture.

SUMMARY OF THE INVENTION

Accordingly, this invention provides a pair of cosmetic gloves for smoothing and firming wrinkled skin on the hands and arms of the wearer and which are sheer enough to display the smoothed and firmed skin, while providing protection against exposure to the weather. The gloves are formed from sheer and elastomeric yarn, such as "Helenca" yarn, which when placed on the hands and arms will apply tension to the skin to smooth and firm any loose skin or wrinkles. The tension on the skin applied by the gloves can be varied by providing a pair of overlapped straps on the end of each glove which are adjustably connected on the back of the wearer.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
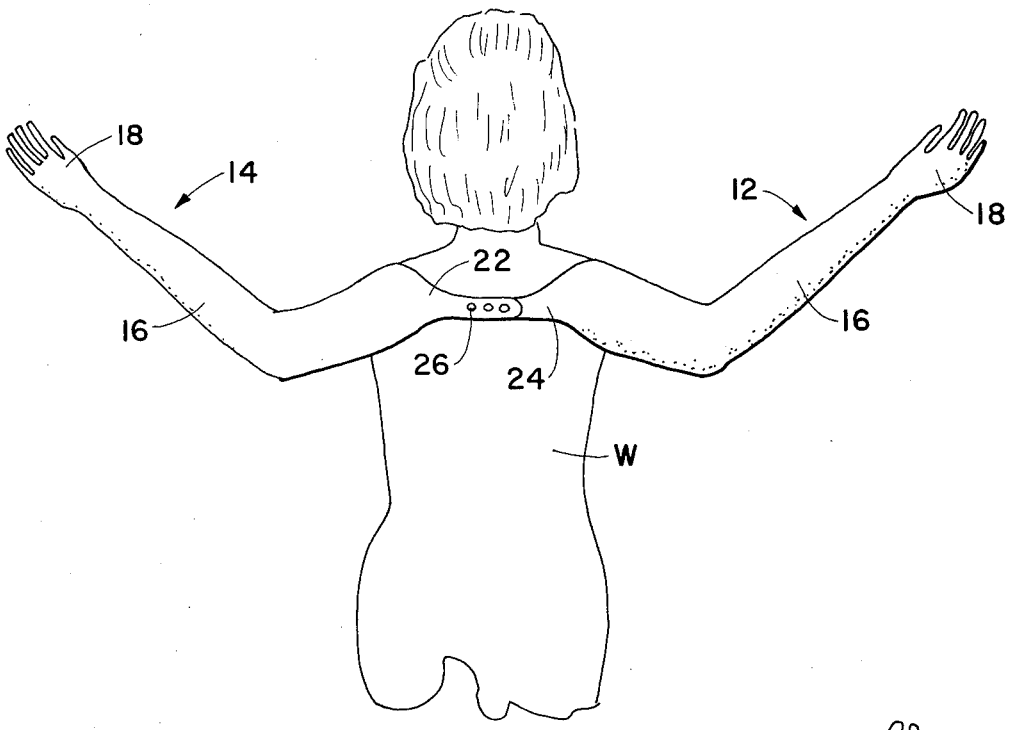
FIG. 1 is a back view in elevation of the gloves of this invention worn by a user.
Figure 2:
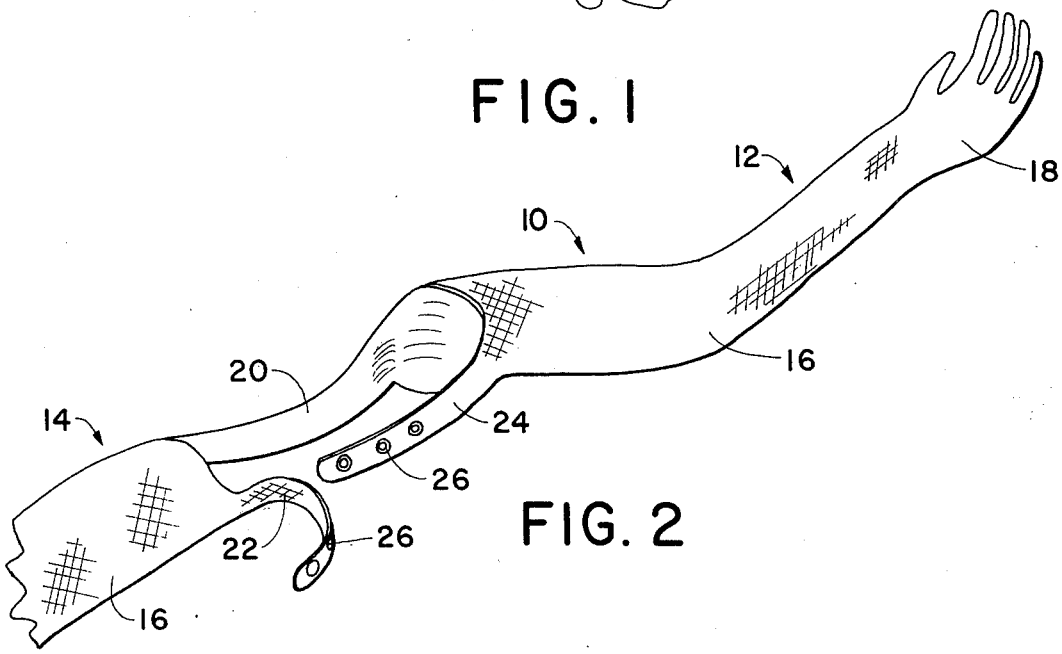
FIG. 2 is a partial perspective view of the gloves of FIG. 1.
Figure 3:
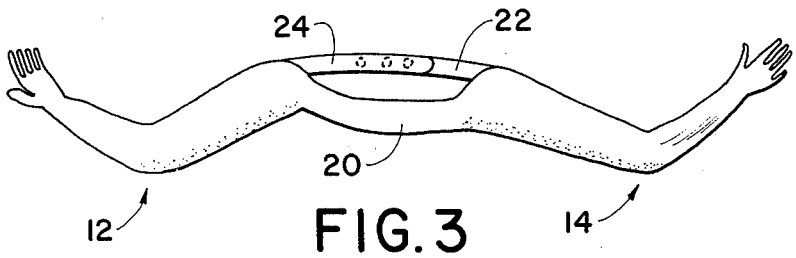
FIG. 3 is a front view in elevation of the gloves shown in FIG. 2.

Referring now to the drawing in detail, wherein the numerals indicate like elements throughout the several views, the pair of gloves 10 of the present invention include a right glove 12 and a left glove 14 having arm-receiving portions 16 connected at one end to hand-receiving portions 18. The arm-receiving portions 16 of each glove are connected at their opposite ends by an integral band of material 20.

A strap 22 is also connected to the end of arm-receiving portion 16 of left glove 14, while a similar strap 24 is connected to the end of arm-receiving portion 16 of right glove 12. Straps 22 and 24 are adapted to be connected by complemental snap fasteners 26 on each strap.

Gloves 12 and 14 are formed from sheer and elastomeric yarn, such as "Helenca" yarn, which when placed on the hands and arms of wearer W will apply tension to the skin to smooth and firm any loose skin or wrinkles. The tension on the skin applied by glooves 12 and 14 can be varied by overlapping straps 22 and 24 on the back of the wearer W and adjustably connect the straps to each other by the use of different snap fasteners 26. When worn, gloves 12 and 14 will not only protect the wearer W from moisture and cold, but will expose the hands and arms as smooth and unwrinkled.

If desired, gloves 12 and 14 can be manufactured in various lengths such as to cover the wrists only, or the wrists and arms to the elbow, without connecting the gloves 12 and 14. The tension supplied by the material alone is sufficient to smooth and firm the skin.

I claim:

1. Cosmetic gloves for smoothing and firming the skin comprising hand-receiving portions for covering the hands formed from elastomeric and sheer yarn, an arm-receiving portion integral with each of said hand receiving portions, an end of each of said arm-receiving portions including a strap, and means for adjustably connecting said straps in overlapped relation.

2. A pair of cosmetic gloves in accordance with claim 1 wherein said last-named means includes a plurality of snap fasteners.

* * * * *